United States Patent [19]

Huffnagle et al.

[11] 4,412,566

[45] Nov. 1, 1983

[54] APPARATUS FOR TRANSPOSING A PAIR OF PARALLEL AND ADJACENT CONDUCTORS INTO A VERTICAL RELATIONSHIP

[75] Inventors: Clifton W. Huffnagle, Camp Hill; LeRoy J. Morningstar, Middletown; Charles I. Tighe, Jr., Hershey, all of Pa.

[73] Assignee: AMP Incorporated, Harrisburg, Pa.

[21] Appl. No.: 97,015

[22] Filed: Nov. 23, 1979

[51] Int. Cl.[3] ..... B21F 1/02

[52] U.S. Cl. ..... 140/147

[58] Field of Search ..... 140/2, 71 R, 147, 93 R, 140/105; 29/33 F

[56] References Cited

U.S. PATENT DOCUMENTS

| | | | |
|---|---|---|---|
| 2,337,055 | 12/1943 | Mathias et al. | 140/147 |
| 3,864,010 | 2/1975 | Wasserlein, Jr. | 339/97 R |
| 3,866,296 | 2/1975 | Tucci | 29/203 MW |
| 3,874,764 | 4/1975 | Volinskie | 339/97 R |
| 3,936,933 | 2/1976 | Folk et al. | 140/147 |
| 3,963,319 | 6/1976 | Schumacher et al. | 339/99 R |
| 4,026,629 | 5/1977 | Dechelette et al. | 339/97 P |
| 4,035,050 | 7/1977 | Volinskie | 339/99 R |
| 4,053,197 | 10/1977 | Teagno | 339/99 R |
| 4,125,137 | 11/1978 | Shatto, Jr. | 140/147 |
| 4,132,251 | 1/1979 | Folk et al. | 140/147 |
| 4,132,252 | 1/1979 | Shatto, Jr. | 140/147 |
| 4,140,360 | 2/1979 | Huber | 339/176 MF |
| 4,260,209 | 4/1981 | Zell et al. | 339/14 R |

*Primary Examiner*—John McQuade

*Attorney, Agent, or Firm*—Richard B. O'Planick; Adrian J. LaRue

[57] ABSTRACT

Apparatus is disclosed for terminating flexible flat electrical cable, including means for transposing selected pairs of adjacent conductors into a vertical orientation for subsequent common termination in a single terminal slot. The transposing means includes conductor pushing blades each of generally inverted U-shaped profile having outwardly divergent bottom surfaces, and a template having profiled channels therein defined by inwardly convergent sidewalls of a prescribed angled configuration. The cable is positioned above the template, and upon downward actuation of the conductor pushing blades against the selected pairs of adjacent conductors, said conductors are made to rotate into a vertical orientation while proceeding deeper into the profiled template channels. A combing member is further disclosed for preorientation of the selected conductor pairs prior to their insertion into the template.

8 Claims, 17 Drawing Figures

APPARATUS FOR TRANSPOSING A PAIR OF PARALLEL AND ADJACENT CONDUCTORS INTO A VERTICAL RELATIONSHIP

BACKGROUND OF THE INVENTION

1. Field of the Invention

This invention relates to apparatus for terminating flat electrical cable. In particular, the invention resides in apparatus having means capability for selectively orienting pairs of cable conductors into a parallel arrangement in the vertical plane.

2. The Prior Art

For many electrical interconnection applications, it is desirable from both an economic and performance standpoint to utilize flexible flat transmission cable. Typical cables comprise a plurality of conductors which are coplanarly arranged in a predetermined horizontal configuration of ground and signal conductors. For example, the ground and signal conductors in such a cable may be alternately arranged G—S—G—S—G . . . ; or the cable may provide double ground conductors between each signal conductor as in a G—S—G—G—S—G—G . . . arrangement. Use of these cables, however, has been restricted because of the difficulty in achieving connectorized cable end termination. Problems have been encountered due to the fine gauge of the conductors involved, the close center line spacings between adjacent conductors and the inability of the industry to achieve tooling which could mass terminate closely spaced conductors.

Several connector concepts have been proposed for terminating the types of transmission cable described above. One connector approach envisions the termination of a flat cable having two adjacent ground conductors between each signal conductor by the insertion of each adjacent ground conductor pair into a single terminal slot. Intuitively this approach has great appeal, but achievement of tooling for accomplishing such a termination has heretofore been futile. The adjacent conductors, to be commonly terminated, should ideally be transposed from the horizontal plane represented by the cable, into a mutually vertical orientation prior to termination. Such a transposition, however, must not interfere with termination of the adjacent signal conductors; nor can it result in damage to the conductors. Moreover, the tooling must orient the conductors in a cable in a dependable fashion, without binding. Also, the tooling should be compatible with standard automation techniques in order to achieve cost effective mass terminations.

U.S. Pat. No. 4,260,209 discloses a connector of the type described above and rudimentary termination tooling for said connector, and is hereby incorporated by reference. The termination apparatus comprises a standard press having modular tooling for mass insertion of cable conductors into a connector cover. While this apparatus works well and has been generally well received by the industry, certain shortcomings prevent it from representing an ideal solution to the termination problems outlined above. Specifically, the preorientation of dual ground wires prior to the termination thereof cannot be assured to any great degree of certainty. Also, the horizontal to vertical transposition of the dual ground wires is often inhibited by a binding of the conductors as they are jointly inserted into the connector cover.

SUMMARY OF THE INVENTION

The present invention resides in apparatus intended for preorienting transmission cable conductors into a prescribed scheme in anticipation of subsequent electrical and mechanical termination. The apparatus includes means for transposing selected pairs of adjacent conductors into a vertically parallel orientation, and comprises a template having channels therein defined by inwardly convergent sidewalls of a prescribed angled configuration. The subject transposition means further comprises conductor pushing blades of prescribed profile each intended for capturing one pair of adjacent conductors and inserting same into one profiled template channel. Upon downward actuation of the conductor pushing blades, said conductors are made to rotate into a vertical orientation while proceeding deeper into the profiled template channel. Combing means is further provided for preorienting the selected conductive pairs prior to insertion into the template.

Accordingly, it is an object of the present invention to provide apparatus for mass terminating cable conductors into a prescribed space and scheme wherein selected adjacent pairs of conductors in the horizontal plane are transposed into a parallel cofiguration in the vertical plane.

It is a further object of the present invention to provide apparatus for establishing positive electrical and mechanical termination of flat cable conductors.

A still further object of the present invention is to provide apparatus for dependably mass terminating cable conductors on closely spaced center lines.

Yet a further object of the present invention is to provide apparatus for mass orienting and terminating cable conductors, which apparatus being readily produced, assembled, and operated.

These and other objects, which will be apparent to one skilled in the art, are achieved by a preferred embodiment of the present invention which is described in detail below, and which is illustrated in the accompanying drawings.

BRIEF DESCRIPTION OF THE ACCOMPANYING DRAWINGS

FIGS. 10, 11, 12, 13, 14, 15, 16, and 17 are diagrammatic views of one conductor receiving channel of the subject template member, showing the sequential insertion of two adjacent conductors therein.

DETAILED DESCRIPTION OF THE PREFERRED EMBODIMENT

Figure 1:
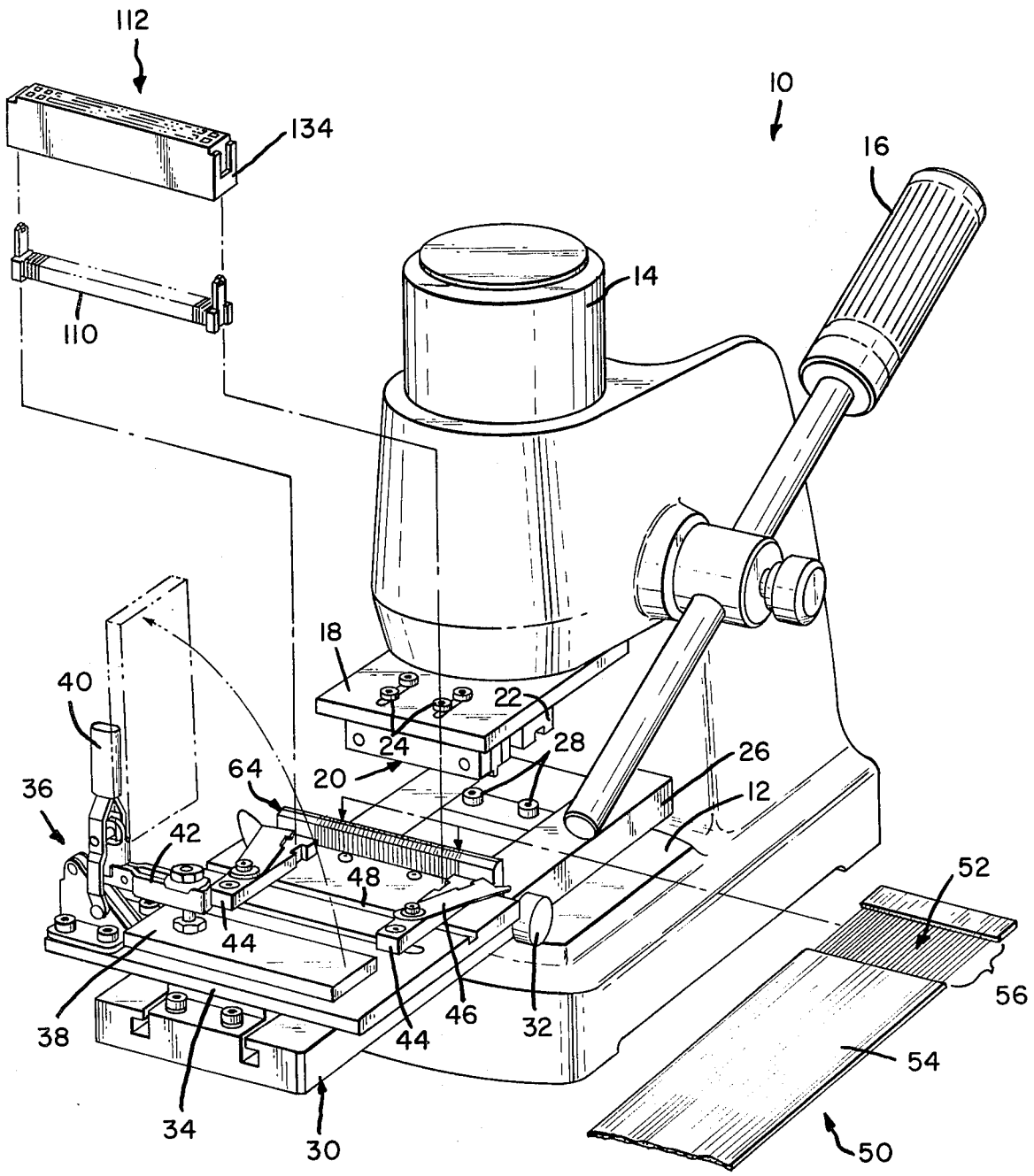
FIG. 1 is an exploded perspective view of the subject termination apparatus.

Referring first to FIG. 1, the subject invention comprises a press assembly 10 of a general type commonly available to the industry. The press assembly 10 includes a lower support surface 12, and a ramming member 14 movable toward and away from support surface 12 upon actuation of a lever 16. A mounting plate 18 is affixed to a lower end of the ramming member 14, and a forward modular tooling assembly 20 and a rearward ramming head 22 are attached to the mounting plate 18 by means of screws 24.

Figure 5:
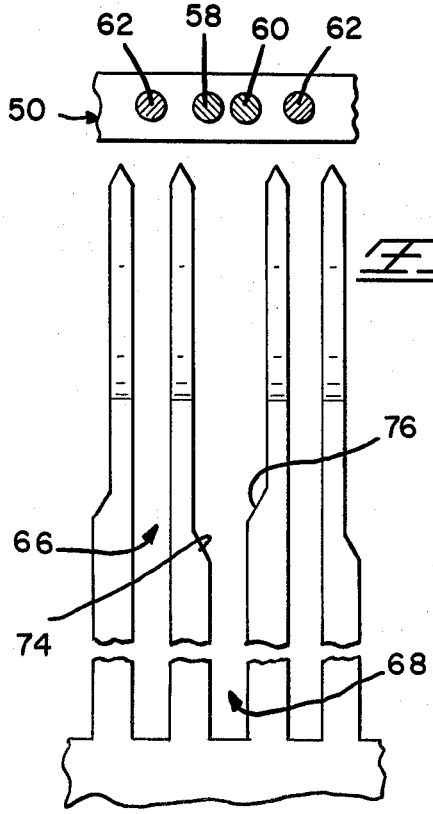
FIGS. 5 and 6 are frontal views of the combing member of the subject apparatus prior and subsequent to, respectively, the insertion of cable conductors therein.

A base plate 26 is mounted upon the support surface 12 by means of screws 28, and a carriage assembly 30 is positioned to straddle the sides of the base plate 26 in the manner indicated. The carriage assembly 30, having coaster members 32 positioned adjacent opposite sides of the base plate 26, is reciprocally movable along support surface 12 as the coaster members 32 of assembly 30 slideably bear against the support surface 12, and, by their location adjacent sides of the base plate 26, add lateral stability to the carriage assembly 30. A support plate 34 is situated upon the carriage assembly 30, and a clamping assembly 36 is provided consisting of a clamping bar 38, an actuating lever 40, and linkage arm means 42. The clamping bar 38 is downwardly movable toward the support plate 34 upon actuation of the lever 40 through the linkage arm means 42. Provided upon the support plate 34 adjacent an interior end thereof are parallel spacer blocks 44, each of which having a pivotally mounted retention clip 46 attached thereto. A transverse groove 48 is further provided within the support plate 34 extending between the spacer blocks 44. The subject assembly 10 is intended for termination of a flat electrical cable 50 having a plurality of horizontally parallel conductors 52 encased within an outer dielectric sheath 54. The cable is prepared for termination having the outer sheath 54 removed from an axial length (indicated at 56) of the conductors 52 proximate the free end thereof. As shown in FIG. 5, the conductors 52 within the cable 50 comprise pairs of adjacent ground conductors 58, 60 positioned between signal conductors 62. While the principles of the present invention find particular application for such a cable, the subject apparatus is also intended to facilitate termination of other cables having other internal configurations. For example, the subject apparatus can terminate a cable having only a single ground conductor between each signal conductor.

Figure 2:
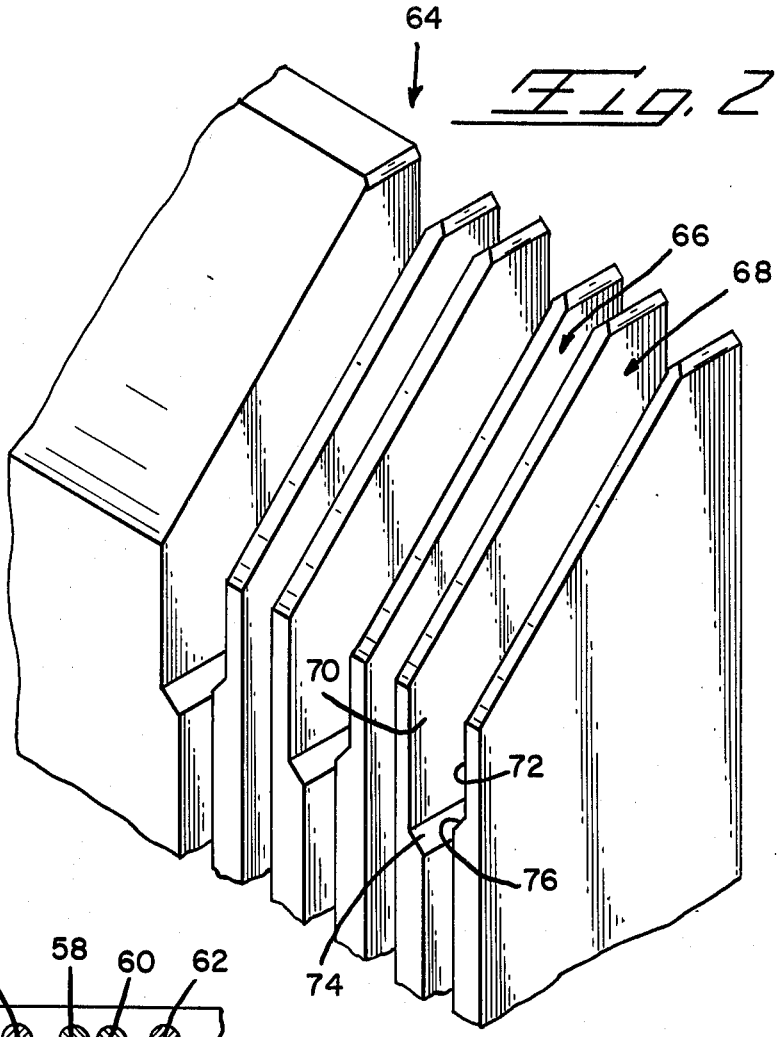
FIG. 2 is a perspective view of a portion of the combing member of the present invention.

Referring now to FIGS. 1 and 2, a combing member 64 is positioned upon the carriage support 34 at an interior end thereof, and is provided with alternately arranged signal conductor receiving slots 66 and ground conductor receiving slots 68. Each ground conductor receiving slot 68 is defined by opposing sides 70, 72 each having an inwardly and downwardly projecting shoulder 74, 76 respectively. The shoulders 74, 76 are positioned at differing depths within the slot 68 as indicated.

Figure 3:
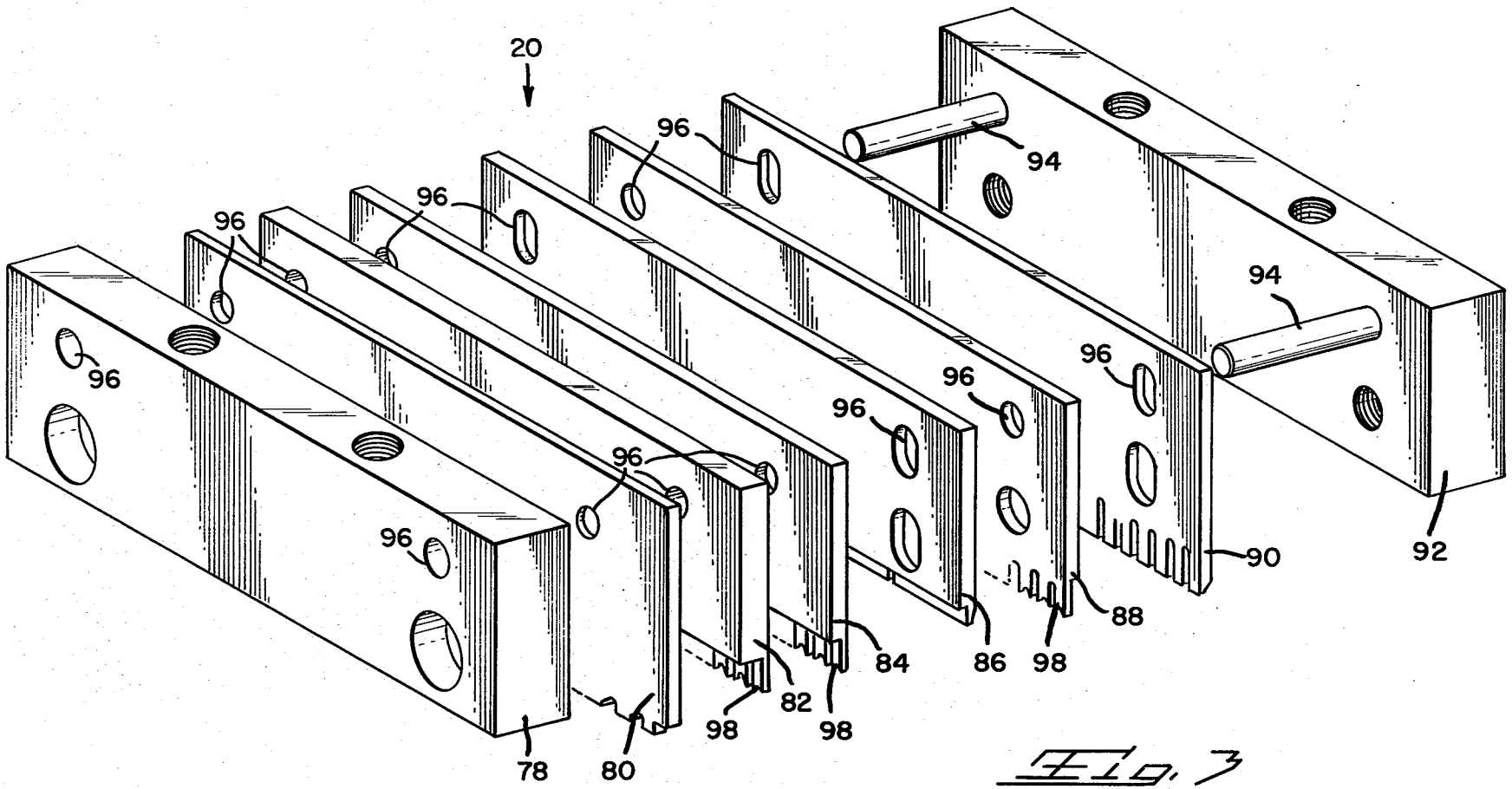
FIG. 3 is an exploded perspective view of the modular tooling head of the subject apparatus.
Figures 10, 11, 12, 13:
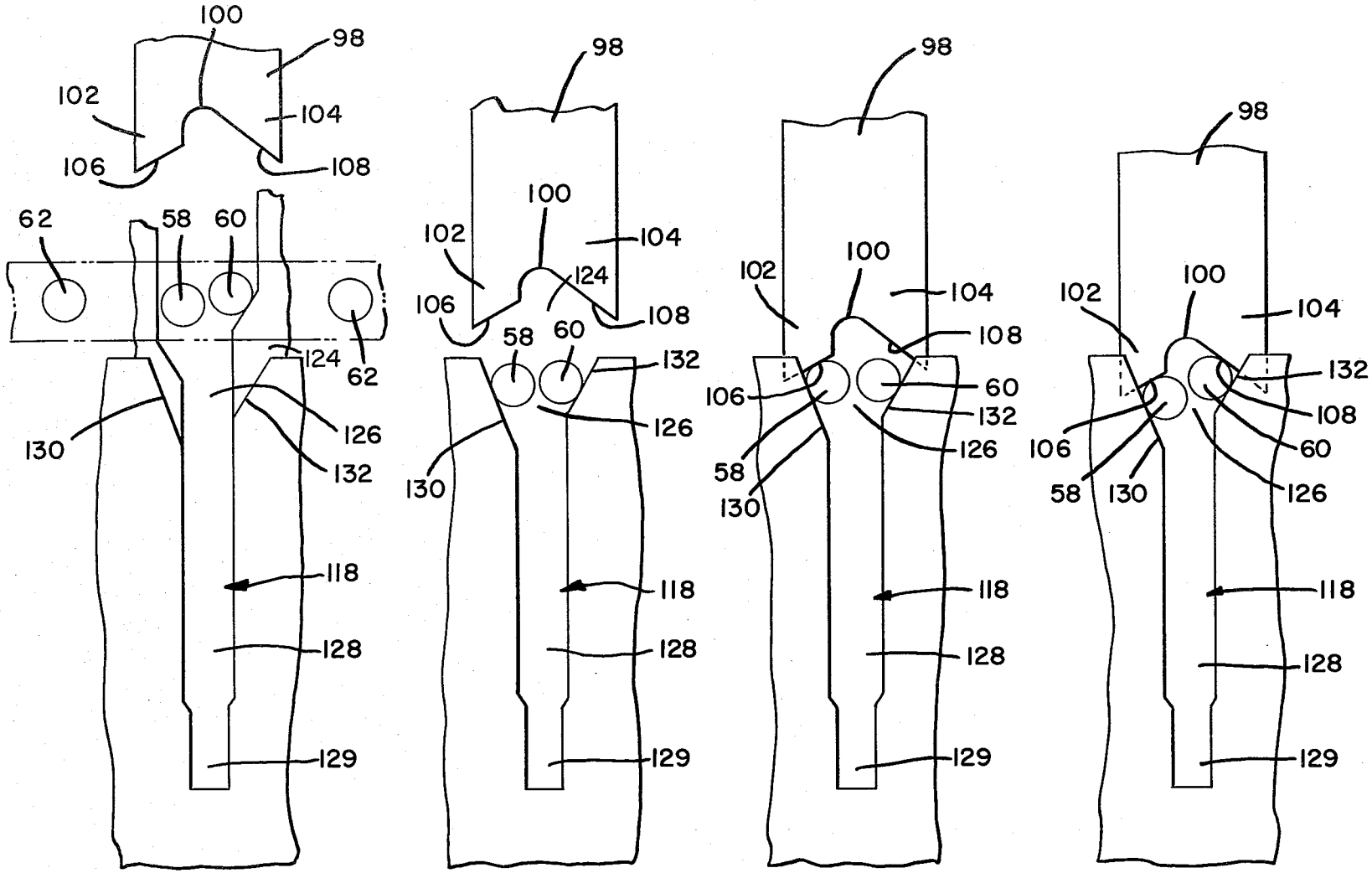

FIG. 3 illustrates the forward modular tooling assembly 20, comprising a front mounting block 78, a conductor pushing and turning plate 80, conductor cutting plates 86, 90, conductor pushing and turning plates 82, 84, 88 and a rearward mounting block 92 having assembly rods 94 projecting therefrom. The assembly rods 94 are intended for insertion through appropriately configured apertures 96 provided in the plates. Structure and operation of a modular tooling package of this general type is described in the aforementioned and identified copending application which is incorporated by reference. Pursuant to the present invention, conductor pushing plates 82, 84, and 88 are provided with depending blades 98 of prescribed profile. Each blade 98, as best shown by FIG. 10, has a generally inverted U-shaped profile composing a central bight portion 100 and outer depending legs 102, 104 having outwardly divergent conductor engaging bottom surfaces 106, 108 respectively. Surface 106 diverges from the bight portion 100 at an angle comparatively smaller than the angle of divergence of surface 108 for a purpose explained in detail below. A typical angle of divergence for surface 106, as illustrated, is 30°, and for surface 108, 60°. The magnitude of these angles could vary, however, without departing from the teachings of the present invention as long as their comparative dissimilarity is preserved.

Figure 4:
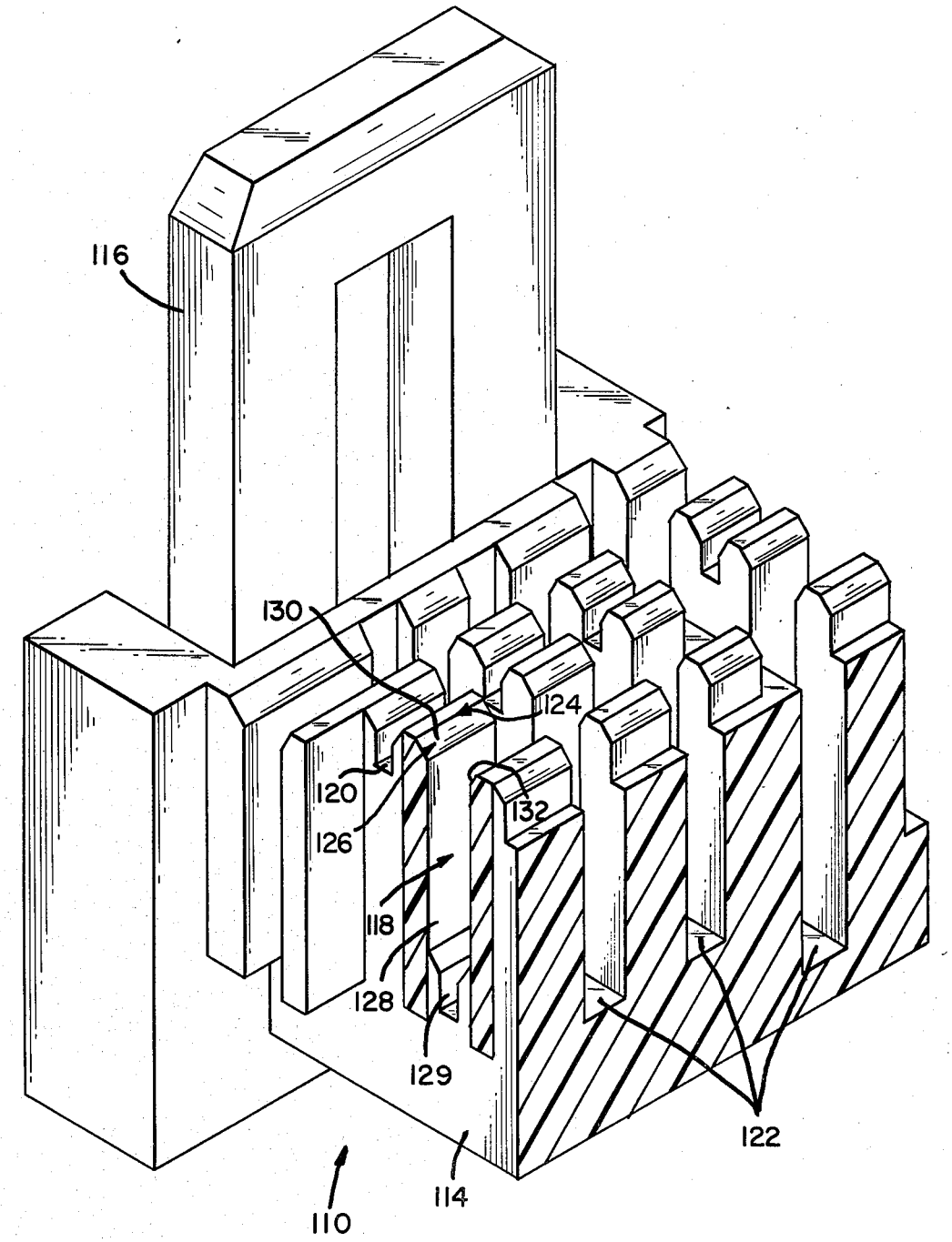
FIG. 4 is an exploded perspective view of the template member of the subject apparatus.

FIGS. 1 and 4 illustrate the template 110 of the present invention; the template member 110 being representatively shown as a connector cover which is mateably engagable with a connector housing 112. Utilizing the template as a connector cover is one embodiment of the present invention, however, other embodiments of a conductor-handling template utilizing the present disclosure are intended to be within the scope of the present invention. The template member 110 includes a body 114 having outwardly directed tongue projections 116 at opposite ends thereof, and a plurality of alternately disposed, transverse ground conductor receiving channels 118 and signal conductor receiving channels 120 therein. The template 110 further includes longitudinal channels 122 of a structure and function in accordance with the disclosure of the above identified copending application. As shown best by FIG. 4, each ground conductor receiving channel comprises an upper entry region 124 dimensioned to closely receive two ground-conductors which are parallel and spaced apart in the horizontal plane; an intermediate transition region 126; a lower region 128 dimensioned to closely receive ground-conductors which are parallel in the vertical plane; and a bottom region 129 dimensioned for frictionally receiving two vertically oriented ground-conductors therein. The transition region 126 is defined by inwardly and downwardly projecting convergent surfaces 130, 132 which converge inwardly at differing angles representatively shown to be 60°0 and 30° respectively. The template 110 is made engagable with a connector housing 112 having keying slots 134 at each opposite end thereof, each slot for receiving a template tongue projection 116 therethrough.

Figure 6:
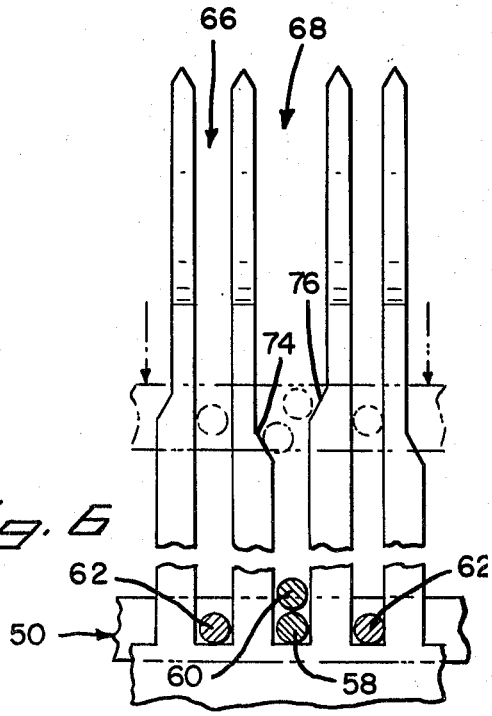
Figure 7:
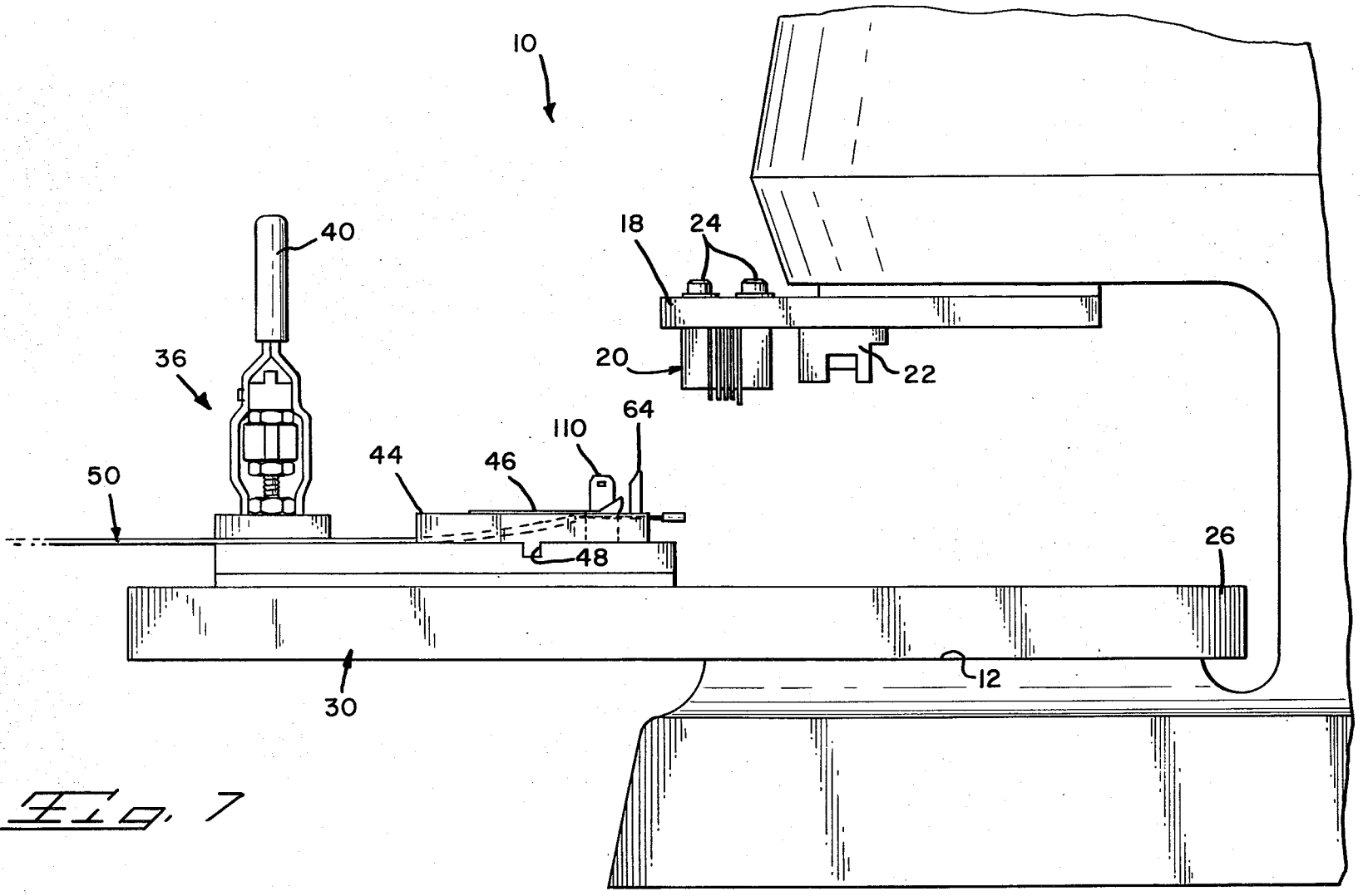
FIG. 7 is a side elevation view of the subject assembly shown subsequent to the insertion of the conductors into the combing member.

Operation of the subject apparatus proceeds as follows. Referring to FIGS. 1 and 7, the template member 110 is initially seated upon support plate 34 between the guide blocks 44, and is locked therebetween by retention clips 46. So locked, the template channels 118, 120 (FIG. 4) are in alignment with the combing member slots 68, 66 respectively. Subsequently, the cable is manually positioned above the template 110 and combing member 64, with the stripped conductor length 56 placed in general alignment with both the template channels 118, 120 and the comb slots 68, 66. Upon downward movement of the cable 50, the signal conductors 62 (FIGS. 5 and 6) enter the comb slots 66, and adjacent ground-conductors 58, 60 enter the combing member slots 68. As illustrated in phantom by FIG. 6, upon further downward movement of the cable, ground-conductors 58, 60 sequentially strike the internal shoulders 74, 76 respectively, within the combing member slot 68. The ground-conductors 58, 60 are thereby influenced centrally of the slot 68 by shoulders 74, 76 and are thus dislocated from their normally horizontal orientation within the cable into a nonhorizontal configuration. The combing member thereby initiates mutual rotation of adjacent ground-conductors toward an eventual parallel orientation in the vertical plane. FIG. 7 illustrates the subject apparatus at this stage of operation procedure. The clamping bar 38 is then lowered to clamp the cable 50 securely against the support plate 34 of the carriage assembly.

Figure 8:
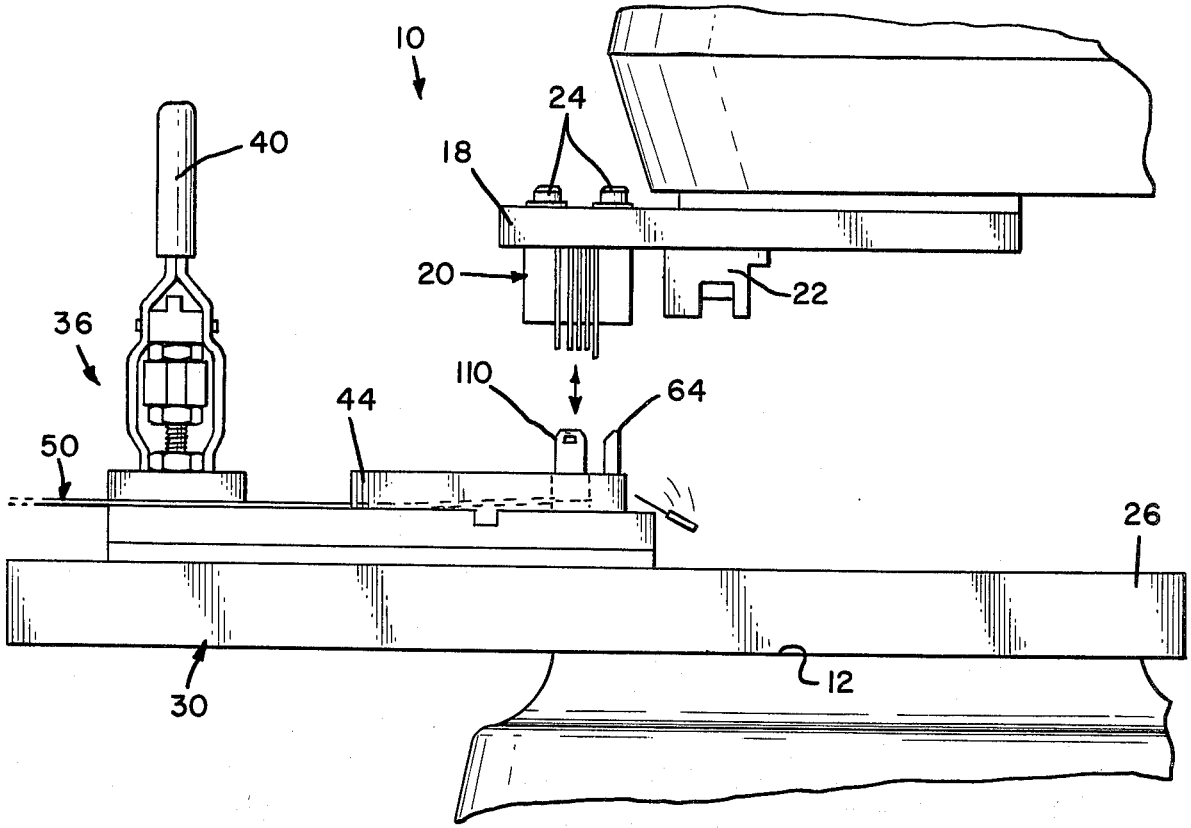
FIG. 8 is a side elevation view of the subject assembly shown subsequent to the insertion of the conductors into the template member.
Figure 9:
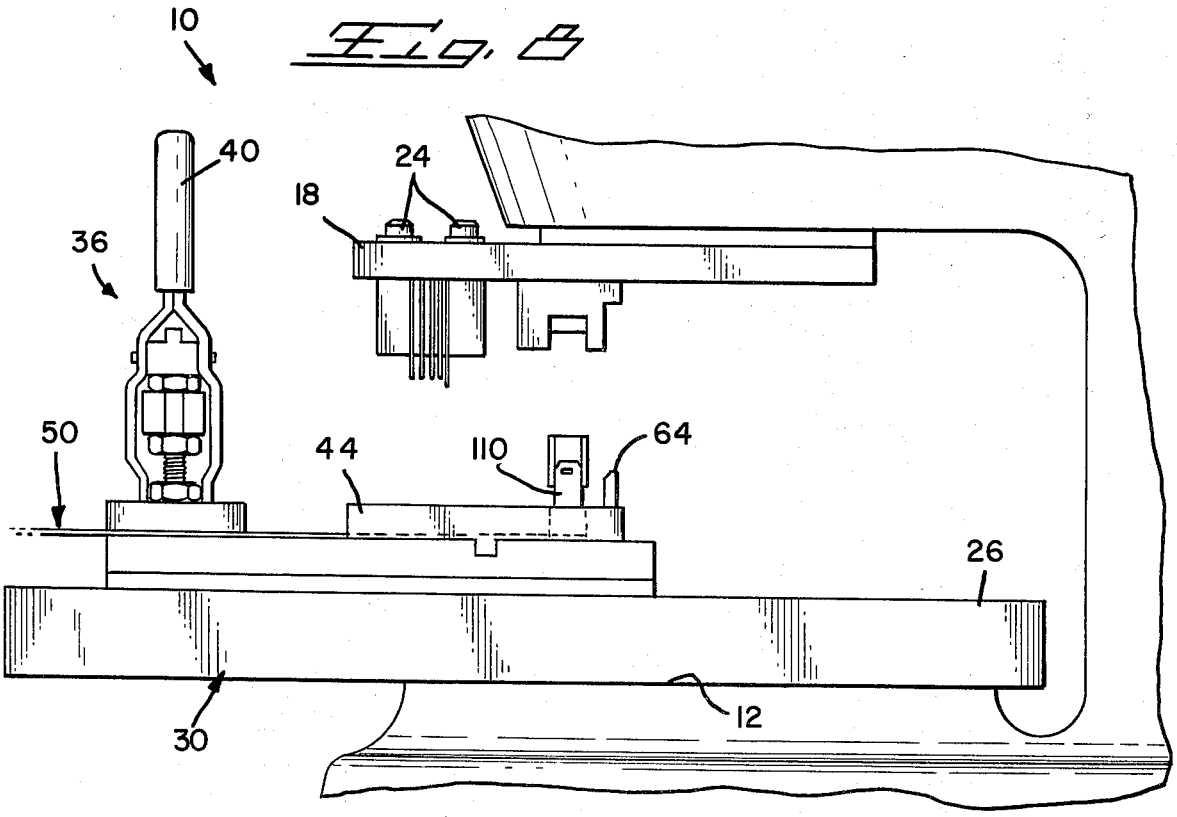
FIG. 9 is a side elevation view of the subject assembly shown prior to final assembly of the connector housing to the template member.

The carriage assembly 30 thereafter is moved forward to a first position beneath the forward modular tooling package 20 (FIGS. 1 and 8). Downward actuation of ramming member 14 brings the conductor pushing blades 98 (FIG. 3) to bear against adjacent ground conductors 58, 60 of the cable 50, and influences said ground conductors into appropriate channels 118 of the template member 110 (FIG. 4). Simultaneously, as shown in FIGS. 3 and 8, the forward ends of the conductors 52 are sheared by the cutting portion of plates 86 and 90.

FIGS. 10–17 sequentially diagram the transposition of adjacent ground conductors 58, 60 into a parallel orientation in the vertical plane as the conductors are inserted deeper into channel 118. The conductors 58, 60 are shown in FIG. 10 as being preoriented in the nonhorizontal arrangement effectuated by their insertion into the combing member slot 68. While this preorientation is desirable, it is not critical for the purposes of the present invention. That is, the template channels 118, profiled in accordance with the instant disclosure, can directly orient horizontally adjacent conductors 58, 60 into a vertical arrangement without utilization of the combing member 64. The combing member 64 preferably can be used to assist in the orientation of the conductors, but said orientation could be achieved without the use of the combing member. As shown in FIG. 12, surface 106 of the blade 98 initially engages conductor 58 upon the lowering of the blade to institute a downward movement of the conductor. Further downward movement of the blade 98 (FIG. 13) causes surface 108 of the blade 98 to engage conductor 60, at which point each blade surface 106, 108 progressively influences said conductors against corresponding template surfaces 130, 132 and deeper into the template channel 118. The complimentarily angled surfaces 106/130 and 108/132 facilitate a free mutual rotation of conductors 58, 60 upon downward progression into the channel 118, and permit the conductors 58, 60 to rotate without constrictive binding.

With general reference to FIGS. 10–17, the following comments are offered. The template member channel, in a functional sense, is configured to reorient a pair of horizontal conductors moved downwardly therein. Said reorientation occurs as the conductors engage respective internal surfaces, each angled at a different pitch, and move inwardly therealong to respective locations central of the channel. The relocation of the conductors into a vertical relationship occurs because the respective time that it takes each conductor to move central of the channel differs as a result of the difference in the length of the internal path (i.e., the angled template channel surface) traversed. The template is intended to function independently to produce the intended reorientation, but by configuring means for downwardly moving a given pair of conductors into a channel according to the profile of the subject pushing blade, improved performance is ahcieved. The cooperation between complimentarily angled surfaces of the pushing blade and corresponding template channel minimizes undesirable binding of the conductors. Further, the operation of the conductor pushing blades and profiled template channels is independent of the combing member. The combing member utility in preorienting the conductors enhances overall performance of the apparatus, but is not necessary to the operation of the template or blades. Similarly, it should be recognized that a conductor pushing blade profiled in the manner set forth above can independently function to rotate parallel conductors into a vertical relationship when brought to bear thereupon, but performance improves if the conductor pushing blade is used in conjunction with a template channel having a profile substantially mirroring that of the blade.

Figure 17:
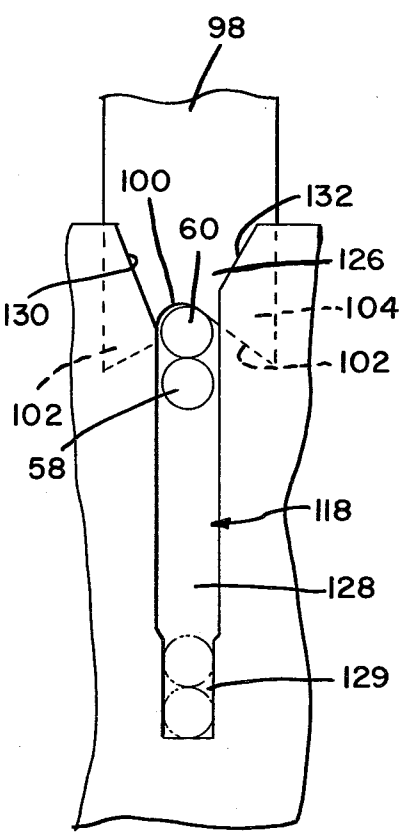
Figure 16:
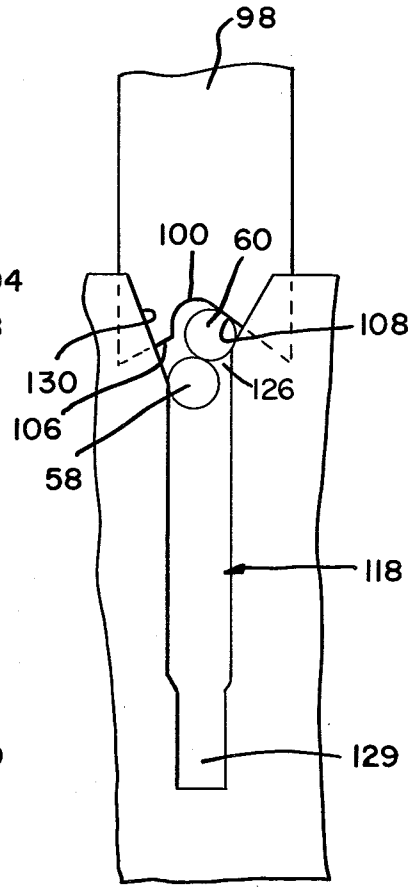
Figure 15:
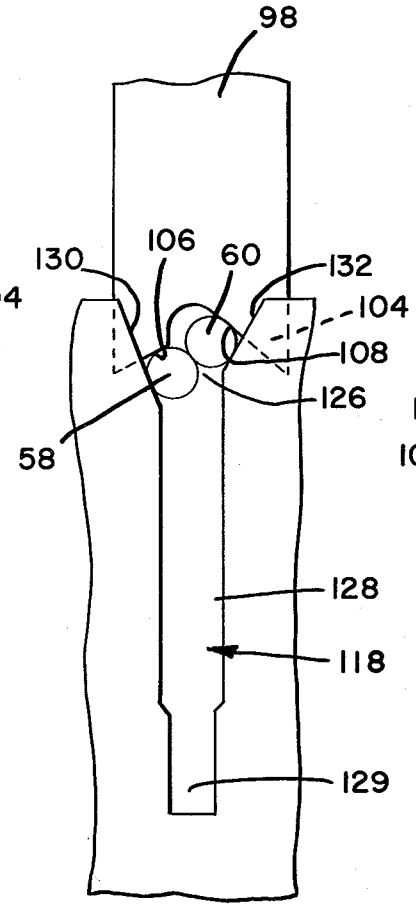
Figure 14:
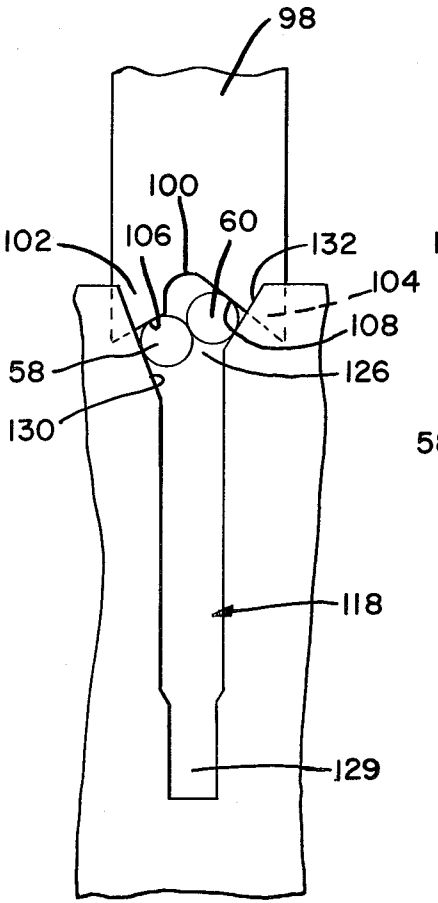

FIG. 17 illustrates the eventual nesting of conductor 60 within the bight portion 100 of the blade 98, and the eventual alignment of conductor 58 therebeneath. The lower region 128 of the channel 118 is dimensioned to frictionally receive and retain the vertically oriented conductors 58, 60 therein. The signal conductors 62 are seated and trimmed in channels 120 (FIG. 4) simultaneously with the insertion and trimming of ground conductors 58, 60 in the channels 118 of the template member 110. Thereafter, the connector housing 112, having terminal means therein (not shown), is positioned upon the template cover with the tongue projections 116 protruding through the housing slots 114. The carriage assembly 30 is then moved to a second work station beneath the ramming head 22. Upon a second downward actuation of ramming member 14, the ramming head 22 engages the connector housing 112 and pressures the housing 112 into mating engagement with the template 110.

The present invention may be subject to many modifications and changes without departing from the spirit or essential characteristics thereof. The present embodiment should therefore be considered in all respects as illustrative and not restrictive of the scope of the invention.

What is claimed is:

1. Apparatus for transposing a pair of conductors from a horizontal, axially parallel and adjacent orientation to a nonhorizontal orientation, comprising:

template means having a profiled channel means extending therein, said channel means having a transition region dimensioned for closely receiving said conductors therein and being defined by first and second conductor directing surface means, said first conductor directing surface means adapted to delay movement of one of the pair of conductors when the one of the pair of conductors is moved into engagement therewith while the other of the pair of conductors in engaging said second conductor directing surface means is directed and guided to a central position of the channel means underneath the delayed one of the pair of conductors so that the conductors will be overlapped; and blade means for pushing the conductors of the pair of conductors along said first and second conductor directing surface means including bight means and first and second conductor pushing surface means, one of said first and second conductor pushing surface means being longer than the other, said first and second conductor pushing surface means adapted to engage respectively the other and the one of the pair of conductors, pushing the other of the pair of conductors along said second conductor directing surface means to said central position while the one of the pair of conductors in moving along said first conductor directing surface means is also moved along said second conductor pushing surface means into said bight means thereby placing the one of the pair of conductors over the other of the pair of conductors whereafter said blade means moves the overlapped conductors to the bottom of said channel means.

2. The apparatus as set forth in claim 1, wherein said first and second conductor directing surface means comprises inwardly angled planar sidewalls defining said transition region of said channel.

3. The apparatus as set forth in claim 1, wherein sidewalls of said channel means converge downwardly to a lower region of said channel means dimensioned to closely receive said conductors therein with said conductors being in a vertical, parallel relationship within said lower region.

4. The apparatus as set forth in claim 1, further comprising: combing means positioned adjacent said template means and having slot means in alignment with said template channel means, said slot means being defined by two opposed sidewalls each providing a tapered shoulder projecting downwardly and inwardly into said slot means, said shoulder projections being located at differing depths from an upper end of said slot means, whereby, upon movement of said pair of conductors downwardly into said upper end of said slot means, said conductors sequentially engage respective ones of said shoulder projections and mutually relocate centrally of said slot means in a nonparallel relationship.

5. The apparatus as set forth in claim 1 wherein said first conductor directing surface means is shorter than said second conductor directing surface means and the angle of said first conductor directing surface means relative to a longitudinal axis of said channel means is greater than that of the angle of said second conductor directing surface means.

6. Apparatus for transposing a pair of conductors from a horizontal, axially parallel and adjacent orientation to a nonhorizontal prescribed orientation, comprising:

template means having profiled channel means extending inwardly therein, said channel means having an upper entry region, an intermediate region, and a bottom region, said entry region including angled surface means for directing the pair of conductors into said intermediate region; and pushing and transposing means for pushing the pair of conductors along said angled surface means while transposing first and second conductors of the pair of conductors from their horizontal orientation to an overlapping orientation within said intermediate region and then pushing the overlapped conductors to said bottom region of said channel means, said pushing and transposing means comprising first and second conductor engaging surfaces and a central bight area, said first and second conductor engaging surfaces extending outwardly from said central bight area with said first conductor engaging surface being shorter than said second conductor engaging surface and said first conductor engaging surface being angled relative to a longitudinal axis of said pushing and transposing means at a different angle than that of said second conductor engaging surface.

7. The apparatus as set forth in claim 6 wherein said angled surface means includes a first surface means and a second surface means, said first surface means is shorter than said second surface means and is at a greater angle relative to a longitudinal axis of said channel means than that of said second surface means.

8. The apparatus as set forth in claim 7 wherein said angled surface means of said template means is substantially mirrored that of said conductor engaging surfaces of said pushing and transposing means.

* * * * *